US006974190B1

(12) United States Patent
Hung

(10) Patent No.: US 6,974,190 B1
(45) Date of Patent: Dec. 13, 2005

(54) ARMREST ADJUSTMENT MECHANISM

(76) Inventor: Yu-Ching Hung, 9F-1, No.248, Sec. 3, Hueilai Rd., Situn District, Taichung City 407 (TW)

( * ) Notice: Subject to any disclaimer, the term of this patent is extended or adjusted under 35 U.S.C. 154(b) by 0 days.

(21) Appl. No.: 11/083,001

(22) Filed: Mar. 17, 2005

(51) Int. Cl.[7] ..... A47C 7/54
(52) U.S. Cl. ..... 297/411.36; 248/118.3; 248/409
(58) Field of Search ..... 297/353, 410, 297/411.36; 248/118.3, 407–409, 411, 414

(56) References Cited

U.S. PATENT DOCUMENTS 5,388,892 A * 2/1995 Tornero ..... 297/411.36
5,393,125 A * 2/1995 Watson et al. ..... 248/414
6,053,579 A * 4/2000 Nelson et al. ..... 297/411.36
6,394,553 B1 * 5/2002 McAllister et al. .... 297/411.36
6,398,309 B1 * 6/2002 Chen ..... 297/411.36
6,419,323 B1 * 7/2002 Chu et al. ..... 297/411.36
6,585,322 B1 * 7/2003 Lai ..... 297/411.36
6,773,072 B2 * 8/2004 Phillips et al. ..... 297/411.35

* cited by examiner

*Primary Examiner*—Peter R. Brown
(74) *Attorney, Agent, or Firm*—Charles E. Baxley

(57) ABSTRACT

An armrest adjustment mechanism that comprises a sleeve, a bracket, an adjustment rod and a pair of adjustment blocks, by pulling the pulling portion of the adjustment rod upward will cause withdrawal of the adjustment blocks and further lead to disengagement of the adjustment blocks from the toothed portion of the sleeve, therefore, a height-adjustment of the armrest can be performed, after being adjusted, the adjustment rod is released and will be pulled back to its original position by the return spring, this will cause outward motion of the adjustment blocks and further lead to an engagement of the adjustment blocks with the sleeve, and thus adjustment of the armrest is accomplished.

4 Claims, 11 Drawing Sheets

ARMREST ADJUSTMENT MECHANISM

BACKGROUND OF THE INVENTION

1. Field of the Invention

The present invention relates to an armrest for a chair, and more particularly to an armrest adjustment mechanism.

2. Description of the Prior Arts

Many chairs have armrests which provide elbow support for users, and at the bottom of the chair is normally provided with a height-adjustment mechanism employed to adjust the height of the chair so as to accommodate user with different body shapes. However, there are few height-adjustment mechanisms for armrest can be found on market, and the conventional armrest adjustment mechanism is not only structurally complex, difficult to be assembled, but also the armrest will swing when it is adjusted to slide up and down. This will affect the smoothness of the adjustment process.

The present invention has arisen to mitigate and/or obviate the afore-described disadvantages.

SUMMARY OF THE INVENTION

The primary objective of the present invention is to provide an armrest adjustment mechanism that is capable of adjusting the height of the armrest smoothly.

The secondary objective of the present invention is to provide an armrest adjustment mechanism that is capable of horizontally rotating the armrest smoothly.

Another objective of the present invention is to provide an armrest adjustment mechanism that is capable of adjusting the horizontal position of the armrest smoothly.

An armrest adjustment mechanism provided in accordance with the present invention comprises:

a sleeve, at both inner sides of which being lengthwise provided a longitudinal toothed portion;

a bracket being moveable in vertical direction and disposed in the sleeve, on a top end of the bracket mounted a moveable assembly and on the bottom of the bracket arranged a first hook portion and a gap located adjacent to the first hook portion;

an adjustment rod, a top end of which being folded to form a pulling head, and at a bottom of which formed a second hook portion, the adjustment rod adjustably disposed on the bracket, and a return spring biased between the second hook portion and the first hook portion;

a pair of adjustment blocks being assembled to both sides of the adjustment rod by means of positioning pins and located in the gap of the bracket, on each of the adjustment blocks being defined a plurality of slant holes for insertion of the positioning pins, and the slant holes are slanted upward and outward gradually, the adjustment block being provided at its outer side with a toothed portion for engagement with and disengagement from the toothed portion of the sleeve;

by pulling the pulling portion of the adjustment rod upward until it slides to the top end of the slant holes of the adjustment blocks, this will cause withdrawal of the adjustment blocks and further lead to disengagement of the toothed portion of the adjustment blocks from the toothed portion of the sleeve, therefore, a height-adjustment of the armrest can be performed, after being adjusted to a desired position, the adjustment rod is released and will be pulled back to its original position by the return spring, so that the positioning pins will slide to the bottom of the slant holes of the adjustment blocks, this will cause outward motion of the adjustment blocks and further lead to an engagement of the toothed portion of the adjustment blocks from the toothed portion of the sleeve, consequently, adjustment of the armrest is accomplished.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
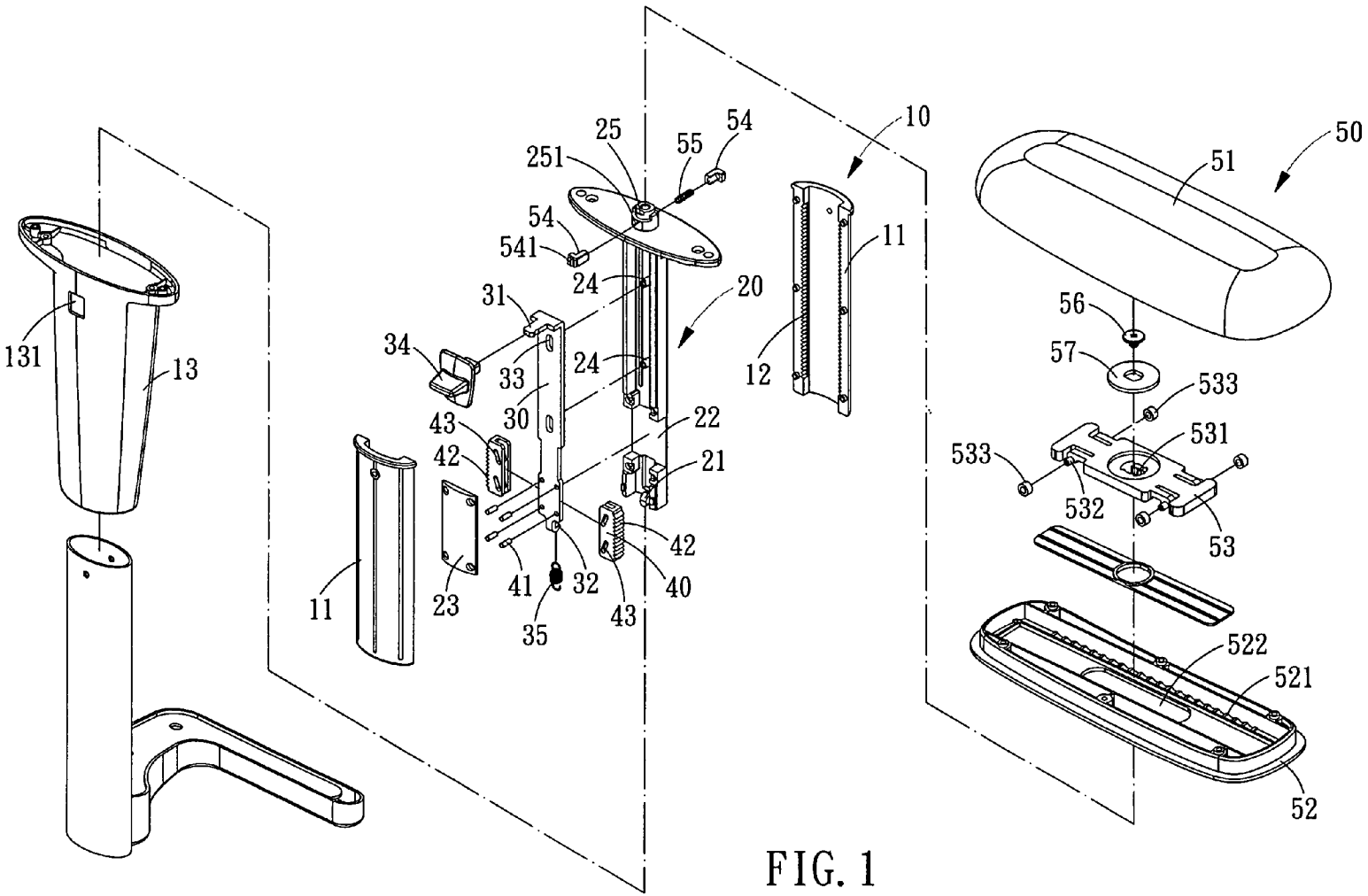
FIG. 1 is an exploded view of an armrest adjustment mechanism in accordance with a first embodiment of the present invention.
Figure 2:
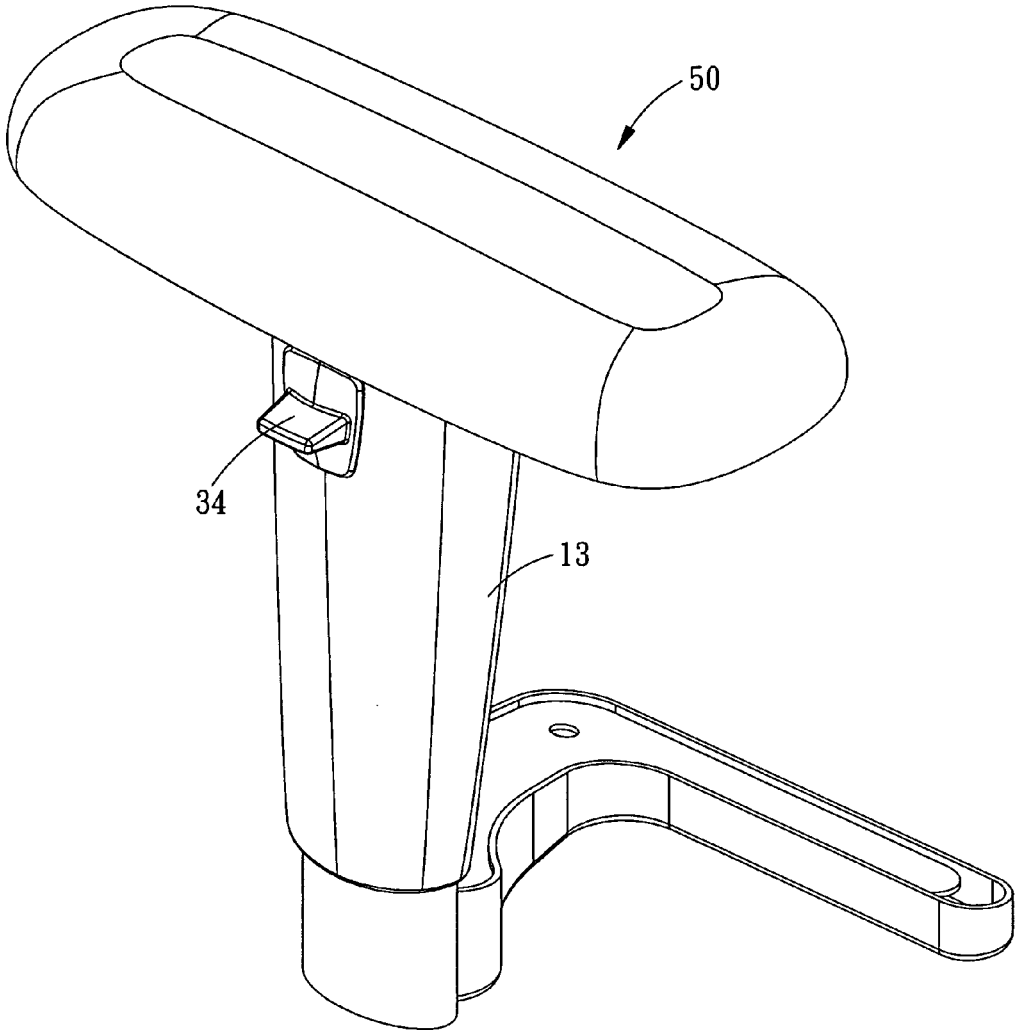
FIG. 2 is an assembly view of the armrest adjustment mechanism in accordance with the first embodiment of the present invention.
Figure 3:
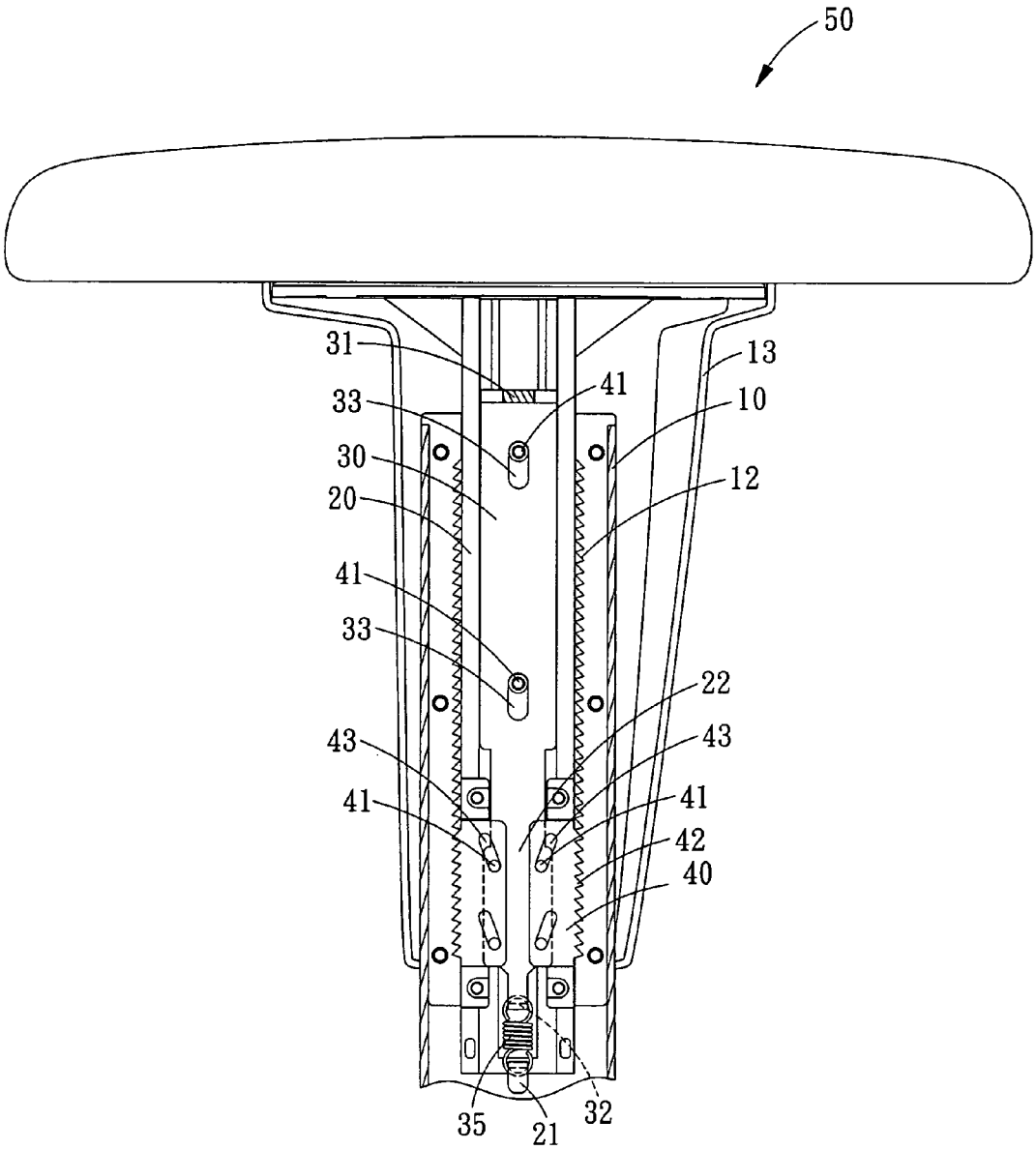
FIG. 3 is a cross sectional view of the armrest adjustment mechanism in accordance with the first embodiment of the present invention.
Figure 4:
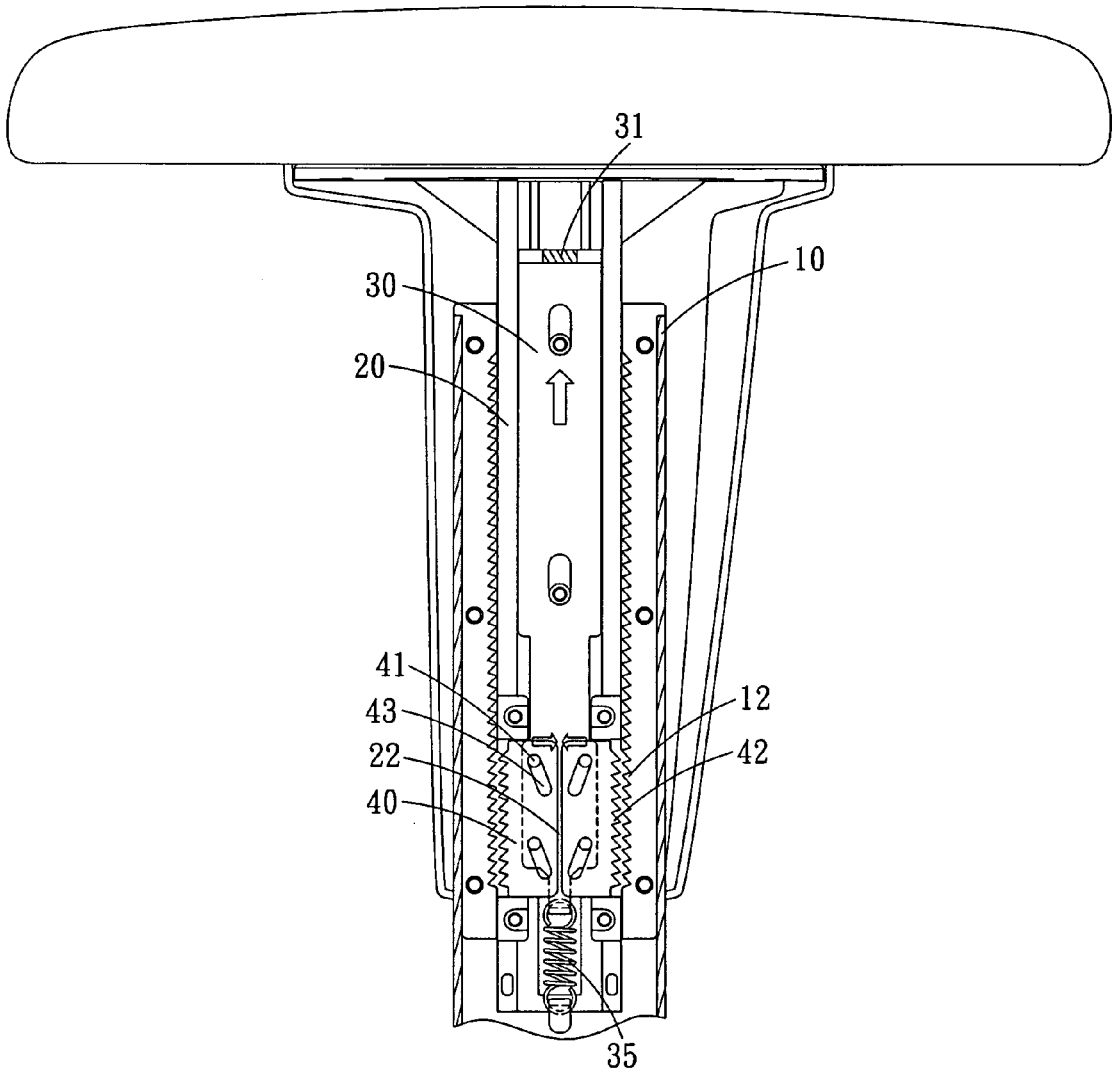
FIG. 4 shows the bracket of the armrest adjustment mechanism in accordance with the first embodiment of the present invention is being pulled upward.
Figure 5:
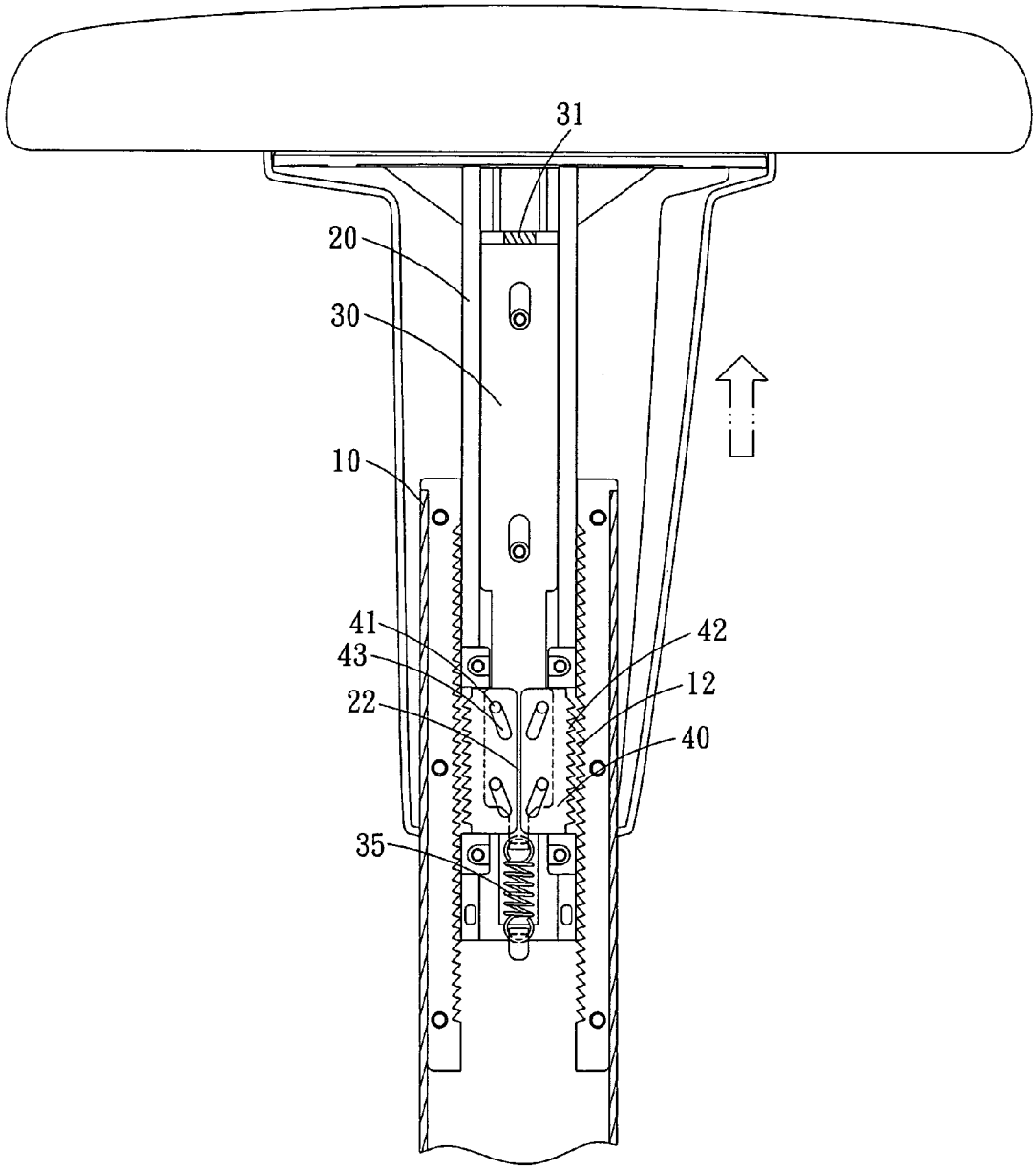
FIG. 5 shows the armrest adjustment mechanism in accordance with the first embodiment of the present invention is being pulled upward.
Figure 6:
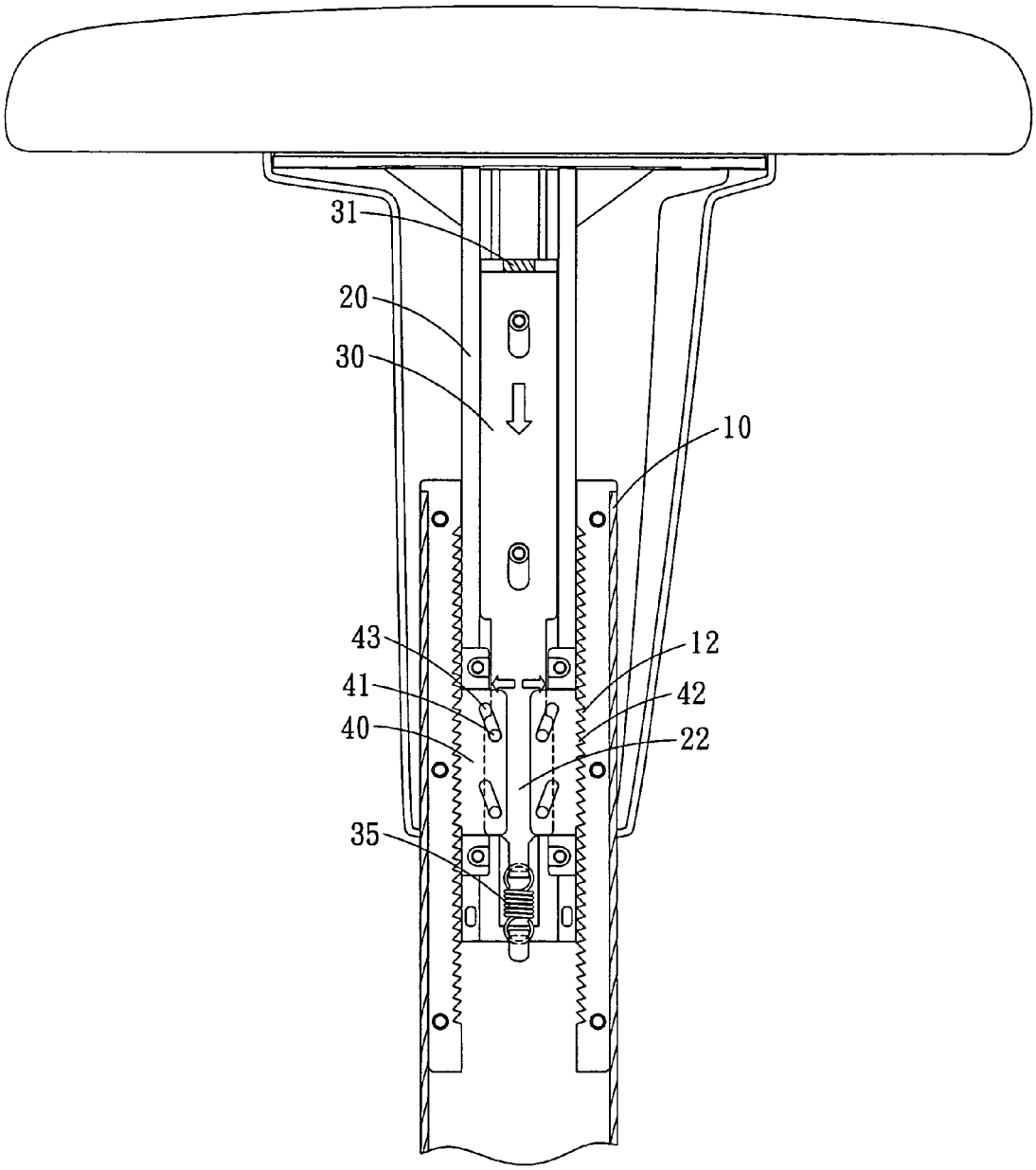
FIG. 6 shows an after-adjustment status of the armrest adjustment mechanism in accordance with the first embodiment of the present invention.

Referring to FIGS. 1–3, an armrest adjustment mechanism in accordance with a first preferred embodiment of the present invention is shown and comprises a sleeve 10, a bracket 20, an adjustment rod 30 and a pair of adjustment blocks 40.

The sleeve 10 includes a pair of symmetrical covers 11, and at both inner sides of the respective covers 11 are provided a longitudinal toothed portion 12. On the sleeve 10 is mounted a sliding bush 13 having an opening 131.

The bracket 20, on the top of which is mounted a moveable assembly 50 and on the bottom of which is arranged a first hook portion 21 and a gap 22 located adjacent to the first hook portion 21. A sealing piece 23 is provided at the top of the gap 22 so that the gap 22 opens laterally, and two projections 24 are located lengthwise between the top end of the bracket 20 and the gap 22. The bracket 20 is moveable in vertical direction and disposed in the sleeve 10.

The adjustment rod 30, a top end of which is folded to form a pulling head 31, and at a bottom of which is formed a second hook portion 32. Between the pulling head 31 and the second hook portion 32 are provided two elongated hole 33 which are arranged lengthwise. The adjustment rod 30 is adjustably disposed on the bracket 20 in such a manner that the pulling head 31 protrudes out of the opening 131 of the slide bushing 13, and then the pulling head 31 can be covered with a protective jacket for easy pulling during adjustment. The elongated holes 33 are correspondingly engaged with the projections 24 of the bracket 20 to limit the motion of the adjustment rod 30 in up-and-down direction. Between the second hook portion 32 and the first hook portion 21 is arranged a return spring 35 for returning the adjustment rod 30 to its original position after adjustment.

The pair of adjustment blocks 40 are "["-shaped in cross section, which are assembled to both sides of the adjustment rod 30 by means of positioning pins 41 and located in the gap 22 of the bracket 20. On each of the adjustment blocks 40 is defined a plurality of slant holes 43 for insertion of the positioning pins 41, and the slant holes 43 are slanted gradually upward and outward. Furthermore, the adjustment block 40 is provided at its outer side with a toothed portion 42 for meshing with the toothed portion 12 of the sleeve 10.

For a better understanding of the operation and function of the first embodiment of the present invention, references should be made to FIGS. 3–6, to adjust the height of the armrest, the user can pull the pulling head 31 of the adjustment rod 30 initially, so as to adjust the positioning pins 41 to the top end of the slant holes 43. Since the pair of adjustment blocks 40 are only able to move breadthwise within the gap 22, plus the slant holes 43 on the adjustment blocks 40 are slanted gradually upward and outward, the upward movement of the respective positioning pins 41 will cause withdrawal of the adjustment blocks 40, and the toothed portion 42 of the adjustment blocks 40 will disengage from the toothed portion 12 of the sleeve 10. At this moment, the height-adjustment of the armrest can be achieved, and the return spring 35 will make the adjustment rod 30 return to its original position after adjustment.

After being adjusted to a desired position, the adjustment rod 30 is released and pulled back to its original position by the return spring 35, meanwhile, the positioning pins 41 slide to the bottom of the slant holes 43 of the adjustment blocks 40. For the same reason that the pair of adjustment blocks 40 are only able to move breadthwise within the gap 22, plus the slant holes 43 on the adjustment blocks 40 are slanted gradually upward and outward, the downward movement of the respective positioning pins 41 will cause outward motion of the adjustment blocks 40 within the gap 22 of the bracket 20, and further lead to an engagement of the toothed portion 42 from the toothed portion 12 of the sleeve 10. Therefore, the armrest can be positioned firmly after adjustment.

Figure 7:
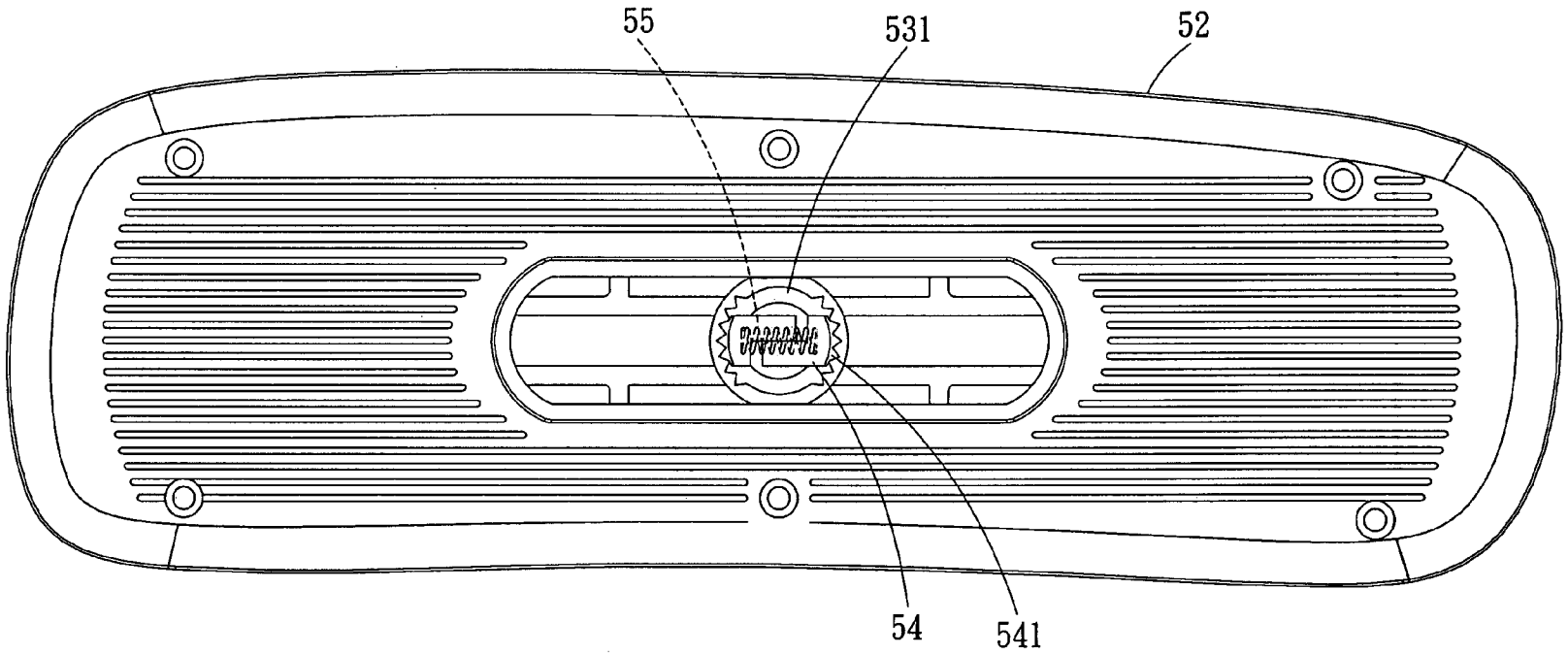
FIG. 7 is a top view of an armrest adjustment mechanism in accordance with a second embodiment of the present invention.
Figure 8:
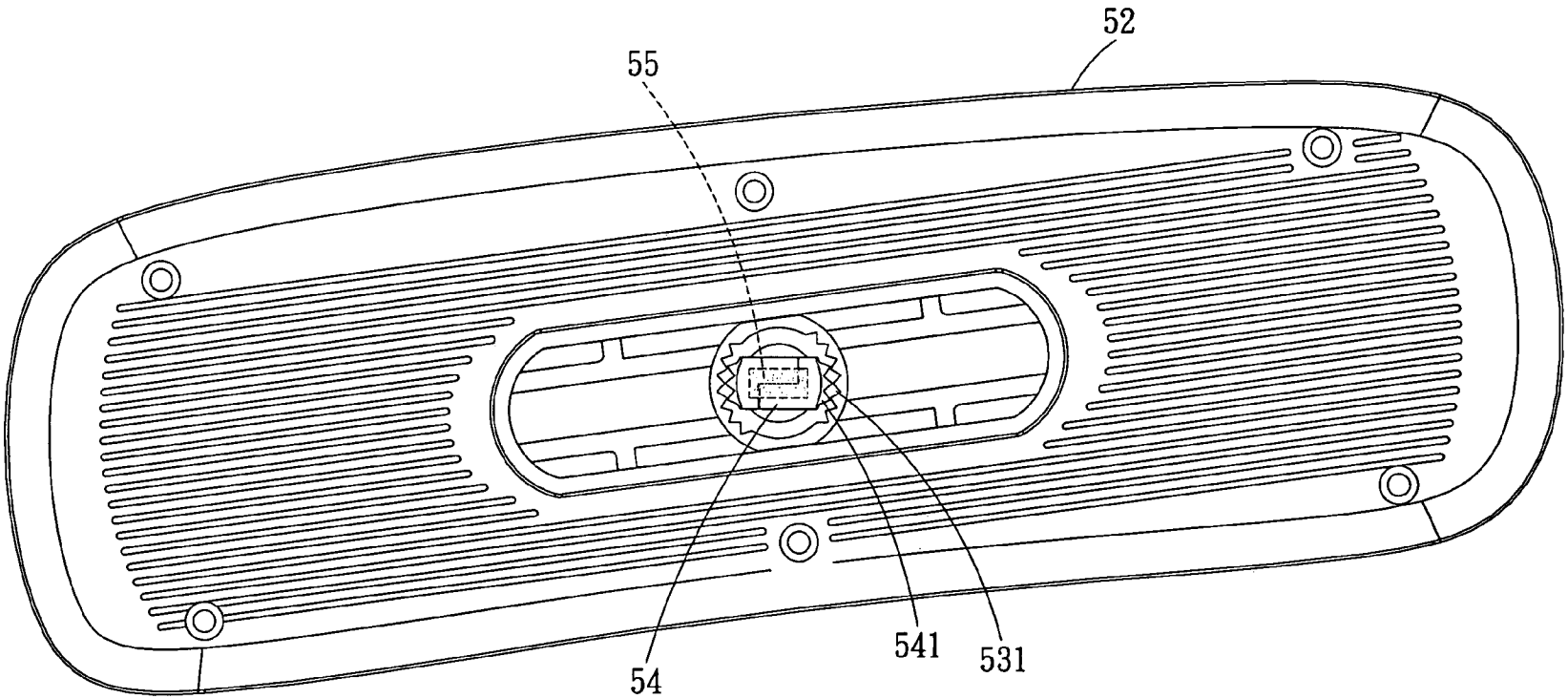
FIG. 8 shows the armrest adjustment mechanism in accordance with the second embodiment of the present invention is being rotated horizontally.
Figure 9:
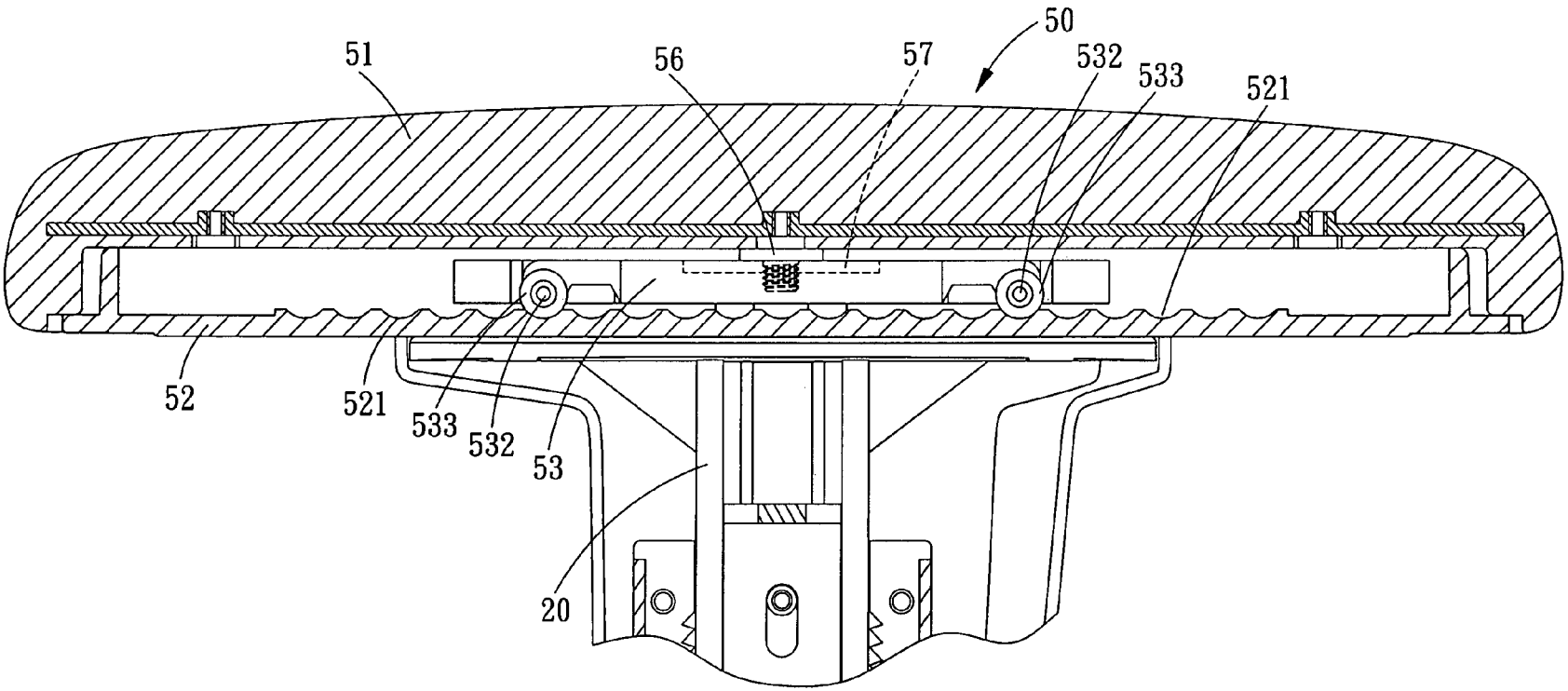
FIG. 9 is a side cross sectional view of the armrest adjustment mechanism in accordance with a third embodiment of the present invention.
Figure 10:
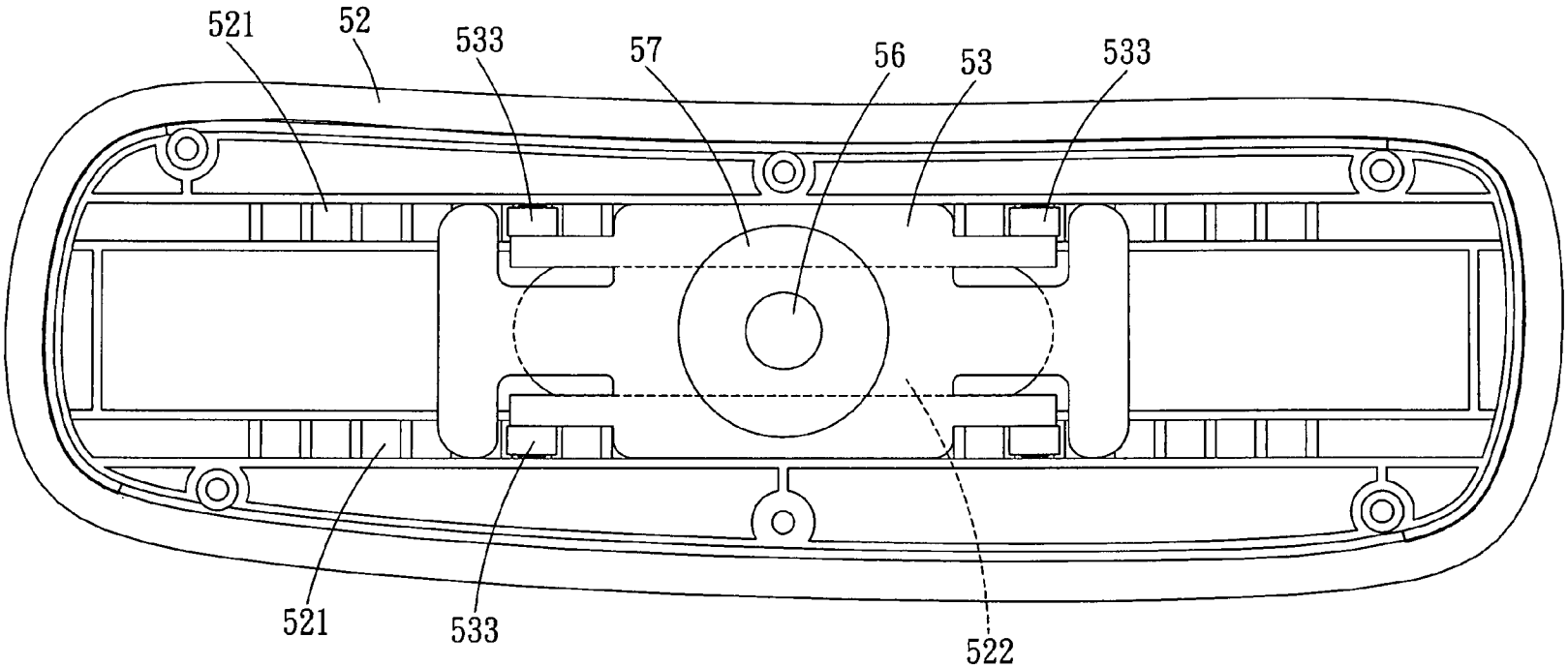
FIG. 10 is a top view of the armrest adjustment mechanism in accordance with the third embodiment of the present invention.
Figure 11:
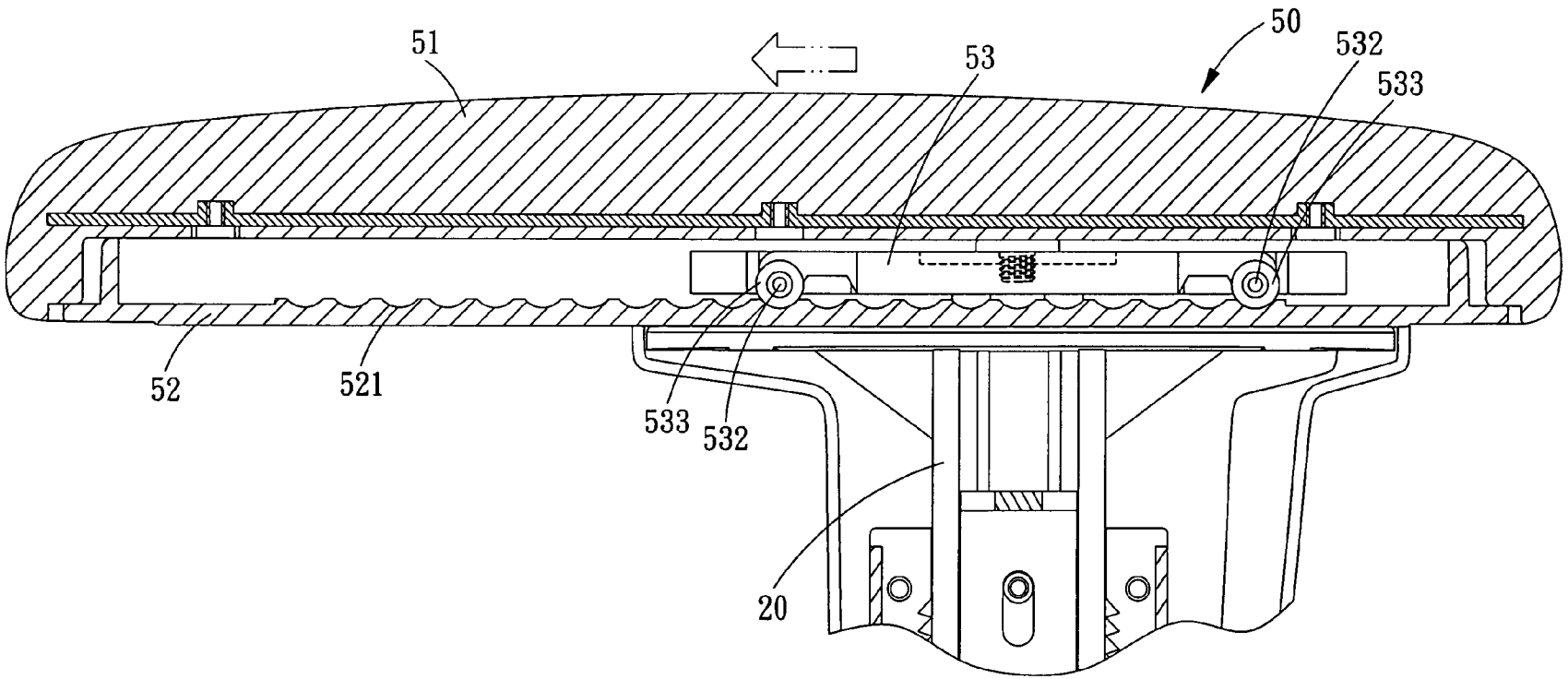
FIG. 11 shows that the armrest adjustment mechanism in accordance with the third embodiment of the present invention is being moved horizontally.

Referring to FIGS. 2, 7 and 8, an armrest adjustment mechanism in accordance with a second preferred embodiment of the present invention is shown and similar to that of the first preferred embodiment, except that:

The moveable assembly 50 on the top of the bracket 20 comprises an upper cover 51, a lower cover 52, a rotary member 53, a pair of locking members 54 and a compression spring 55. On the top end of the bracket 20 is a connecting portion 25 having a transverse hole 251 for accommodation of the locking members 54. On the periphery of the locking members 54 are formed a plurality of teeth 541. The compression spring 55 is biased between the locking members 54, and the rotary member 53 is provided with a central sprocket hole 531 for engaging with the locking members 54.

For a horizontal rotary adjustment of the moveable assembly 50, the user can rotate the armrest, the toothed portion of the sprocket hole 531 of the rotary member 53 will be forced to push the teeth 541 of the locking members 54, so as to make the locking members 54 withdraw and disengage from the sprocket hole 531, and thus the horizontal rotary adjustment of the bracket 20 can be achieved. After adjustment, the locking members 54 will be pushed back by the compression spring 55 and engaged with the sprocket hole 531 of the rotary member 53 again, and consequently the moveable assembly 50 is positioned. Thus, the horizontal rotary adjustment of the armrest is finished.

Referring to FIGS. 2, 9, 10 and 11, an armrest adjustment mechanism in accordance with a third preferred embodiment of the present invention is shown and also similar with that of the first embodiment, except that:

The moveable assembly 50 on the top of the bracket 20 comprises an upper cover 51, a lower cover 52, a rotary member 53, a pair of locking members 54 and a compression spring 55. On the top end of the bracket 20 is a connecting portion 25 that is connected to the rotary member 53 by means of screw 56 and washer 57. On the periphery of the rotary member 53 are provided a plurality of projections 532 on each of which is mounted a roller wheel 533. The lower cover 52 is provided at either side thereof with a positioning portion 521 consisted of a plurality of continuously arranged arc concaves, and an elongated hole 522 is formed between the positioning portions 521. The positioning portions 521 are engaged with the roller wheels 533 so that the upper and lower covers 51, 52 can be positioned after horizontal movement. The elongated hole 522 is used to accommodate the connecting portion 25 so as to restrict the horizontal adjustment of the upper and lower covers 51, 52.

By such arrangements, the horizontal arrangement of the moveable assembly 50 can be performed directly by adjusting the upper and lower covers 51, 52, so as to make them move relative to the bracket 20. After adjustment, the positioning portion 521 of the lower cover 52 will be engaged with the roller wheel 533 of the rotary member 53, and thus the moveable assembly 50 can be positioned, and the horizontal adjustment of the armrest is accomplished.

While we have shown and described various embodiments in accordance with the present invention, it should be clear to those skilled in the art that further embodiments may be made without departing from the scope of the present invention.

What is claimed is:

1. An armrest adjustment mechanism comprising:

a sleeve, at both inner sides of which being lengthwise provided a longitudinal toothed portion;

a bracket being moveable in vertical direction and disposed in the sleeve, on a top end of the bracket mounted a moveable assembly and on the bottom of the bracket arranged a first hook portion and a gap located adjacent to the first hook portion;

an adjustment rod, a top end of which being folded to form a pulling head, and at a bottom of which formed a second hook portion, the adjustment rod adjustably disposed on the bracket, and a return spring biased between the second hook portion and the first hook portion;

a pair of adjustment blocks being assembled to both sides of the adjustment rod by means of positioning pins and located in the gap of the bracket, on each of the adjustment blocks being defined a plurality of slant holes for insertion of the positioning pins, and the slant holes are slanted upward and outward gradually, the adjustment block being provided at its outer side with a toothed portion for engagement with and disengagement from the toothed portion of the sleeve;

by pulling the pulling portion of the adjustment rod upward until it slides to the top end of the slant holes of the adjustment blocks, this will cause withdrawal of the adjustment blocks and further lead to disengagement of the toothed portion of the adjustment blocks from the toothed portion of the sleeve, therefore, a height-adjustment of the armrest can be performed, after being adjusted to a desired position, the adjustment rod is released and will be pulled back to its original position by the return spring, so that the positioning pins will slide to the bottom of the slant holes of the adjustment blocks, this will cause outward motion of the adjustment blocks and further lead to an engagement of the toothed portion of the adjustment blocks with the toothed portion of the sleeve, consequently, adjustment of the armrest is accomplished.

2. The armrest adjustment mechanism as claimed in claim 1, wherein the bracket is provided with projections which are received in longitudinal elongated holes of the adjustment rod, so as to limit movement of the adjustment rod in up-and-down direction.

3. The armrest adjustment mechanism as claimed in claim 1, wherein the moveable assembly on the top of the armrest comprises an upper cover, a lower cover, a rotary member, a pair of locking members and a compression spring, on the top end of the armrest is a connecting portion having a transverse hole for accommodation of the locking members, on outer periphery of the locking members are formed a plurality of teeth, the compression spring is biased between the locking members, and the rotary member is defined with a central sprocket hole for engaging with the locking members, by such arrangements, the moveable assembly is allowed to rotate at the top end of the bracket.

4. The armrest adjustment mechanism as claimed in claim 1, wherein the moveable assembly on the top of the armrest comprises an upper cover, a lower cover, a rotary member, a pair of locking members and a compression spring, on the top end of the armrest is a connecting portion that is connected to the rotary member by means of screw and washer, on outer periphery of the rotary member are provided a plurality of projections on each of which is mounted a roller wheel, the lower cover is provided at either side thereof with a positioning portion consisted of a plurality of continuously arranged arc concaves, and an elongated hole is formed between the positioning portions, the positioning portion is engaged with the roller wheel so that the upper and lower covers will be positioned after horizontal movement, the elongated hole is used to accommodate the connecting portion so as to restrict horizontal adjustment of the upper and lower covers.

* * * * *